United States Patent [19]

Lundberg

[11] 4,316,608

[45] Feb. 23, 1982

[54] LEG AND HIP SLED EXERCISER

[75] Inventor: Duane R. Lundberg, Jefferson, Iowa

[73] Assignee: AMF Incorporated, White Plains, N.Y.

[21] Appl. No.: 104,530

[22] Filed: Dec. 17, 1979

[51] Int. Cl.[3] ..... A63B 23/04

[52] U.S. Cl. ..... 272/117; 272/144

[58] Field of Search ..... 272/93, 116, 117, 118, 272/120, 126, 134, 144, 101-104, 105, 145, DIG. 4; 273/55 R, 187 R; 182/187; 5/62

[56] References Cited

U.S. PATENT DOCUMENTS

| | | | |
|---|---|---|---|
| 1,709,832 | 4/1929 | Barron | 272/105 |
| 2,262,761 | 11/1941 | Gay | 272/61 |
| 2,562,339 | 7/1951 | Socol | 272/144 X |
| 2,689,127 | 9/1954 | Silverton et al. | 272/118 |
| 2,706,632 | 4/1955 | Chandler | 272/61 X |
| 2,783,045 | 2/1957 | Bosch | 272/144 X |
| 2,932,038 | 4/1960 | Sprague | 5/62 |
| 3,152,802 | 10/1964 | Heisler et al. | 272/134 X |
| 3,235,255 | 2/1966 | Leflar | 272/123 |
| 3,286,708 | 11/1966 | Gartner | 272/145 X |
| 3,708,167 | 1/1973 | Potgieter | 272/134 X |
| 3,734,495 | 5/1973 | Nist et al. | 272/144 X |
| 3,817,350 | 6/1974 | Gray | 182/187 |
| 3,822,599 | 7/1974 | Brentham | 273/55 R X |
| 3,866,914 | 2/1975 | Jackson | 272/117 X |

FOREIGN PATENT DOCUMENTS

| | | | |
|---|---|---|---|
| 476133 | 5/1929 | Fed. Rep. of Germany | 272/66 |
| 911938 | 4/1946 | France | 272/144 |
| 2380037 | 10/1978 | France | 272/117 |
| 254571 | 7/1926 | United Kingdom | 272/117 |
| 151595 | 9/1962 | U.S.S.R. | 272/144 |

OTHER PUBLICATIONS

"Marcy", Physical Fitness Equipment Catalog No. 69; Oct. 1969; pp. 23 and 37.

*Primary Examiner*—Richard J. Apley

*Attorney, Agent, or Firm*—David E. Dougherty; Walter Lewis

[57] ABSTRACT

A combination hip and leg sled exerciser having an adjustable toe rest when used as a leg exerciser, and an adjustable body board when used as a hip sled.

1 Claim, 3 Drawing Figures

LEG AND HIP SLED EXERCISER

This invention relates to an exerciser, and more particularly, to a hip and leg sled exerciser.

It is an object of this invention to provide a hip and leg sled type exerciser which can be readily fabricated and assembled, is low cost, and is versatile in that it can be adapted to do different exercises and adjusted to be used by individuals having markely different heights.

Briefly, in the invention the device can be fabricated from readily available metal stock and has a minimum number of parts so as to be readily assembled and low cost, and an adjustable toe rest is provided when the device is used as a leg sled, and an adjustable body board is provided when the device is used as a hip exerciser.

The invention will be better understood by considering the following detailed description taken in connection with the accompanying 3 sheets of drawings in which FIG. 1 is a perspective view of the device when used as a leg sled;

Figure 1:
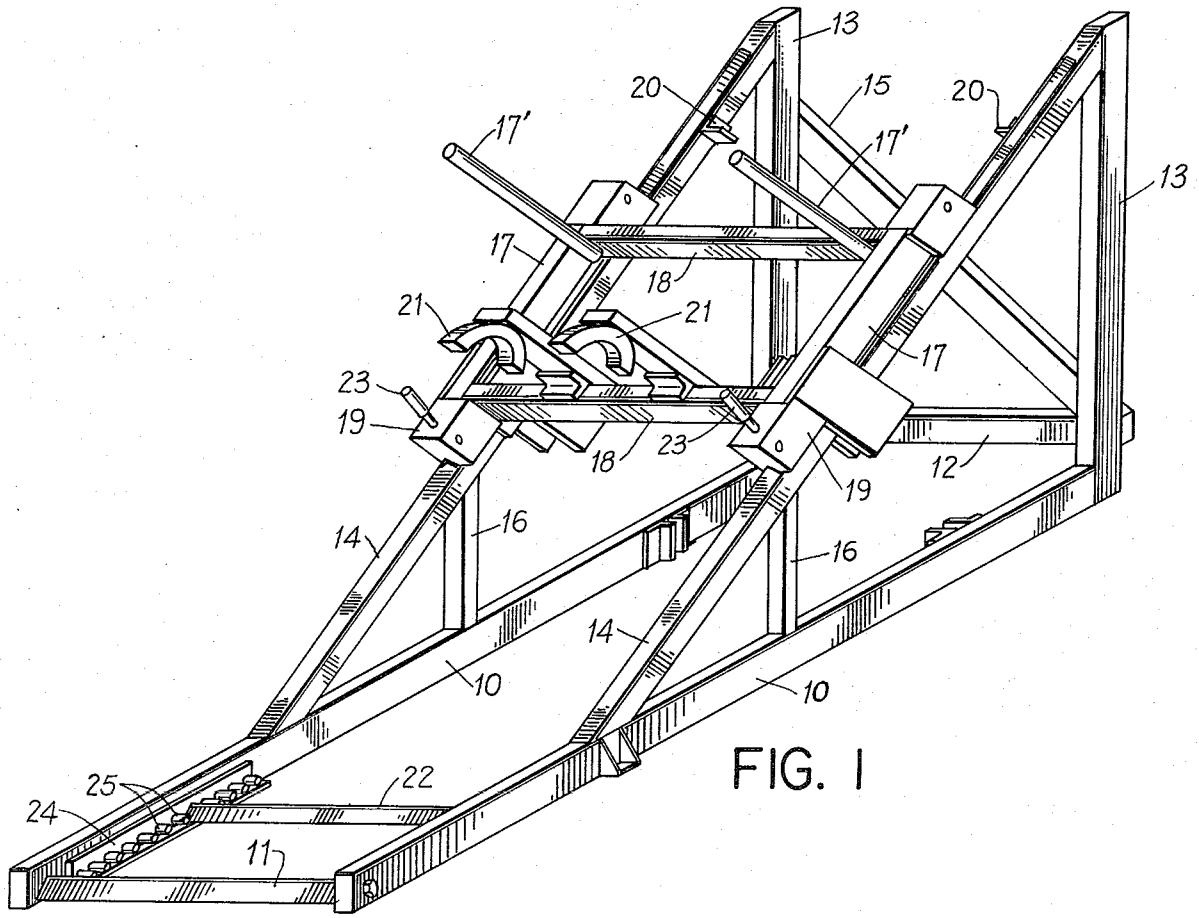

Turning first to FIG. 1, the device comprises a generally rectangular shaped open bottom frame comprising opposite side members 10 and end members 11 and 12. The bottom frame rests on a support surface such as a floor, and positioned on the bottom frame are two opposite side frames having an open triangular shape and comprising vertical end members 13 and sloped or hypotenuse top members 14. The end members 13 are braced by a cross piece 15, and the sloped members 14 are additionally supported off the members 10 by short intermediate vertical members 16.

The members 14 serve as a slide for a carriage comprising two opposite side members 17 interconnected with each other by top and bottom cross pieces 18. Blocks 19 affixed to about the central portion of members 14 serve as bottom stops for the carriage, and brackets 20 up near the members 13 serve as top stops.

Shoulder cradles 21 are attached to the bottom cross piece 18, and an adjustable toe rest is located on the bottom frame near the end member 11 of the bottom frame. Handles 23 are connected to the stop blocks 19.

In use, a person grips handles 23 with his hands, stands on the toe rest 22 and leans forward to place his head between the cradles 21 and nests his shoulders in the cradles 21. The user pushes with his legs to lift weights on the carriage. Rods 17' on the carriage are for receiving centrally apertured disc weights to weight the carriage. When the user's legs are fully extended he is leaning forward at an angle of about 45°, and by bending at the knees he can slowly lower the carriage and then do another lift exercise with the legs. In order to dismount the device the user will first lower the carriage until it comes to rest at the stop blocks 19. The exerciser, although stationary, simulates the exercise performed by a football lineman with a movable blocking sled. Although he is lifting with his legs, the force exerted is from his toes up through his entire body to his shoulders, so he is strengthening his entire body.

The adjustable toe piece 22 comprises an angle iron spanning the side members 10. At their ends near member 11 side members 10 have inside mounted angle irons 24 having a plurality of spaced lugs 25 thereon. The angle iron 22 is positioned on the angle irons 24 so as to rest thereon above one lug and between that one lug and the other two immediately adjacent thereto. Thus, the lugs 25 serve as an index means to position the toe piece 22 straight across the bottom frame, and they also serve to removably lock the toe piece 22 in position against accidental movement. For a tall user the cross toe piece 22 would be positioned closer to the end member 11 and for a shorter person further away therefrom. Thus, the device is readily adjusted for users having a markedly different height simply by moving the adjustable toe rest member 22.

Figure 2:
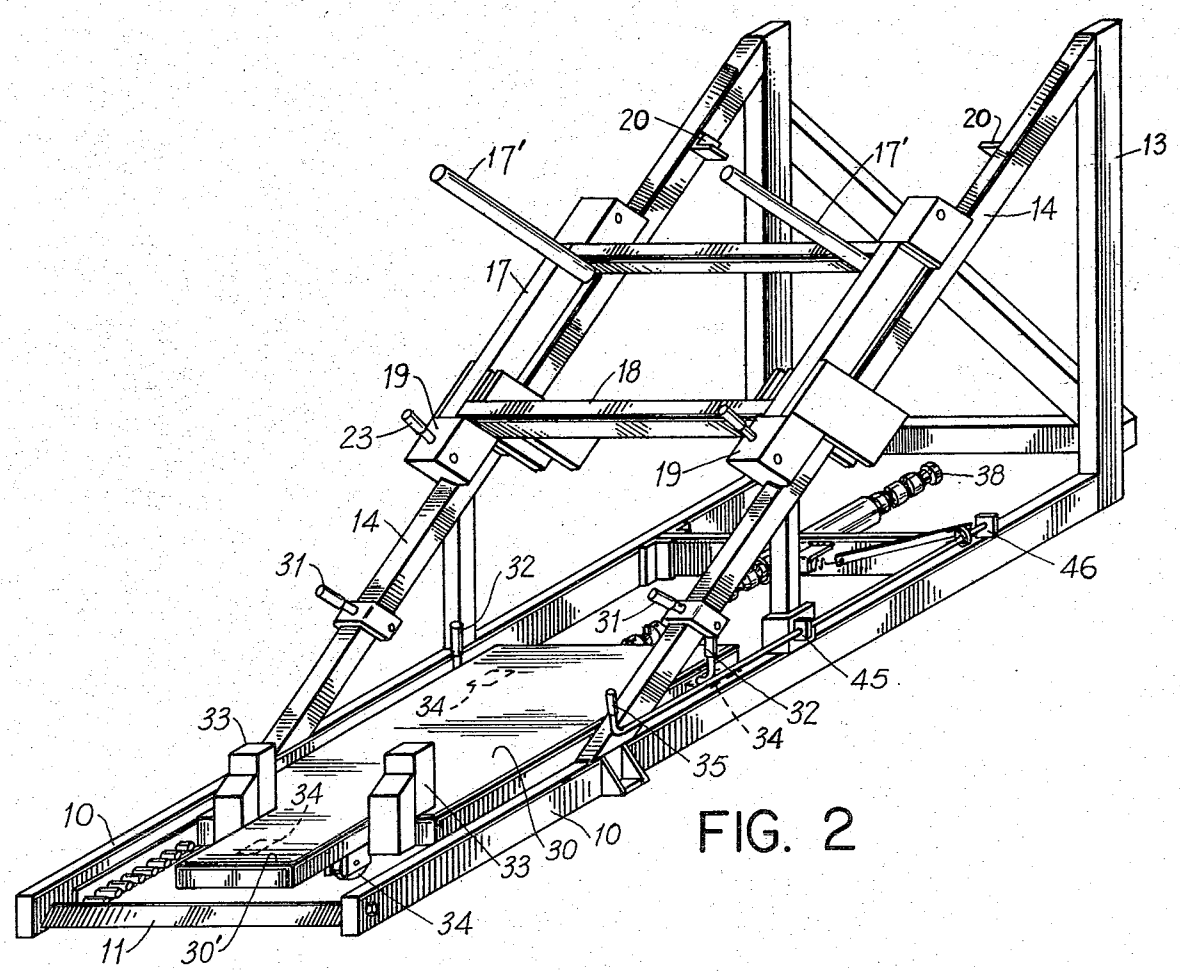
FIG. 2 is a perspective view of the device when used as a hip exerciser.

Turning now to FIG. 2, shown therein is the same basic unit adapted to do still another kind of exercise. Briefly, the cross toe piece 22 of FIG. 1 is removed and an adjustable body board 30 is placed on the floor within the open bottom frame. It is locked in position by a locking mechanism to be described hereinafter. The user lies on the board, and puts his toes up against the bottom cross piece 18 of the carriage and pushes up on it with his legs while lying on his back. This again exercises the whole body but since the user is prone with his back against the board 30 no strain is placed on the user's back. In other words, the user is lifting with his legs from his hips, and not with his back.

Since the same basic frame is used in FIG. 2 as in FIG. 1 it will not be described other than to note the changes thereto. Since the shoulder cradles 21 of FIG. 1 are not needed in FIG. 2 they are removed, although they can be left in place since they will not be in the way of exercising with the FIG. 2 arrangement. As before, weights are mounted on the carriage on the rods 17', and hand grips 31 are added to the sloped members 14 about midway between the bottom carriage stops 19 and the lowermost ends of sloped members 14. Further hand grips 32 are on the board 30 near the lower end thereof.

The board 30 includes some padding on its upper surface, an head extension 30', and a pair of spaced padded shoulder blocks 33 on opposite sides of the extension 30'. When the user is exercising he is lying on his back with his head on the extension 30' and his shoulders up against the blocks 33. In this position the user grips the handles 31, places his toes up against the bottom carriage cross piece 18 and then pushes up on the carriage by straightening his legs. After his legs are fully extended the user lowers the carriage by bending his legs at the knees, and then can perform another lift by straightening his legs again. In order to dismount the device the user lowers the carriage until it comes to rest at the bottom stop blocks 19.

The board 30 is on the floor between the side members 10, and has rollers or wheels 34, on its bottom so that it can be shifted lengthwise in either direction to suit the user, depending on his height. A taller person will want to position the board 30 closer to frame end member 11 than a shorter person.

Once the user starts lifting, since he is pushing on the cross piece 18 there is a reaction on the board 30 tending to push it towards end member 11. Therefore, a releasable locking mechanism is provided to prevent the board 30 from being free to slide backwards, except when it is specifically desired to do that, as when the user is adjusting the board or wants to slide it back so as to provide more room to dismount the device. The locking mechanism is operated by a hand grip 35.

Figure 3:
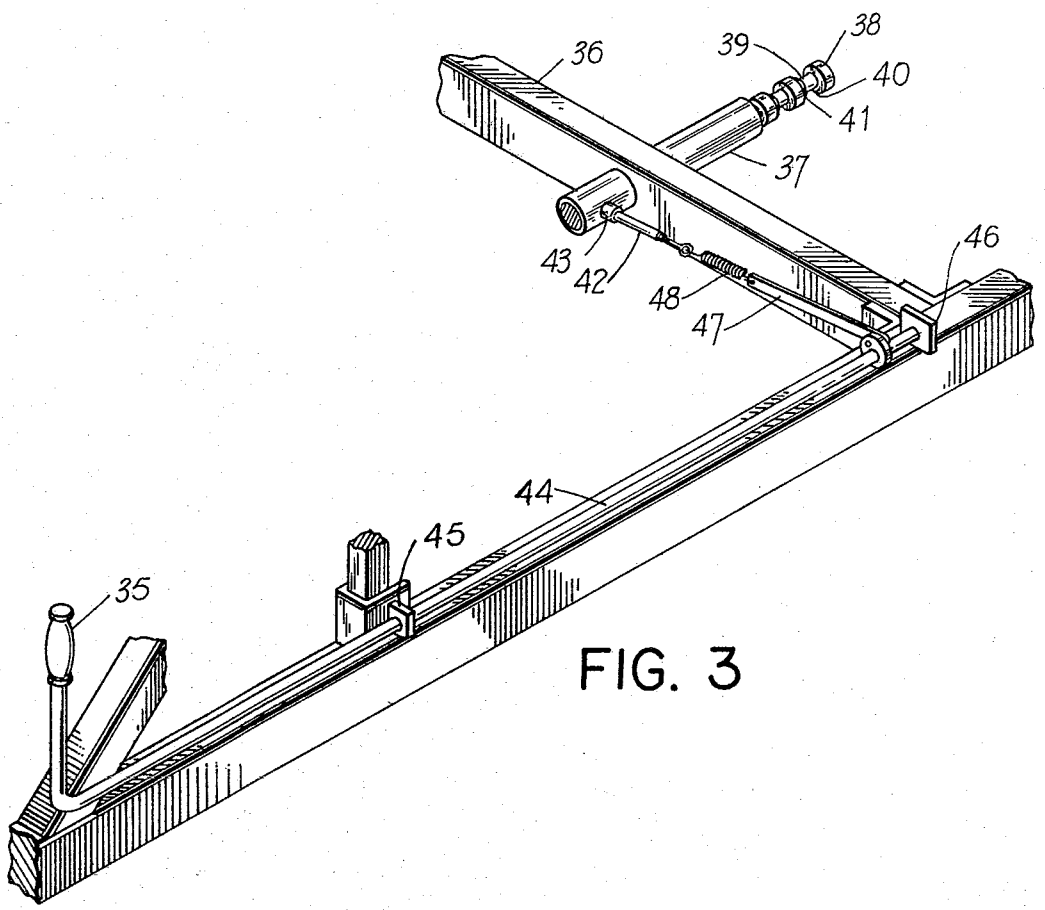
FIG. 3 is a broken away enlarged perspective view of the locking mechanism for the body board shown in FIG. 2.

A bottom cross piece 36 is provided for mounting the locking mechanism, see also FIG. 3, which comprises a tube 37 mounted in cross piece 36 and aligned with the lengthwise axis of the board 30. A lock rod 38 slides in the tube 37, its rear end being affixed to the board 30. The rod 38 has a series of grooves 39 therein, the right hand sides of the grooves 39 being defined by right angle shoulders 40 but its left hand sides being defined by tapered shoulders 41. A lock plunger 42 is slidable in a sleeve 43 which enters a hole formed in the side of tube 37. When the hand grip 35 is in the position shown the plunger 42 enters the grooves 39, but when hand grip 35 is turned to the right the plunger is withdrawn from the grooves 39. In the withdrawn position of the plunger 42 the board can be shifted in either direction by a user lying on the board to position it exactly where he wants it. After that, the user will return the grip 35 to its illustrated up position to allow the plunger 42 to re-enter the grooves 39. In this position the board 30 is locked against sliding back because the plunger is engaged with the shoulders 40, but it is not securely locked against sliding in the opposite direction because of the tapered shoulder 41. In other words, once the user starts pushing on the cross piece 18 board 30 should not move back. However, the user can over-ride the lock in order to shift the board further in. For example, at the bottom of a leg lift, if the user wants to get more bending at his knees he can easily do this while lying on the board and shifting it in with his weight while holding the grips 31 without the need for operating the lock handle 35. However, if he wants to shift the board 30 to the left at any time, as when he is dismounting the device, he must first operate the lock handle 35. If the lock handle should be in the open position when he starts to lift, the board 30 will move to the left as the user pushes with his toes on the cross bar 18, so he will know that he has to return the lock handle 35 to its up locked position.

The hand grip 35 is attached to a long rod 44 mounted on the right side bottom frame side member 10 in a pair of brackets 45, 46 so as to be free to turn therein. A crank arm 47 connected to the rod 44 in turn is connected to the lock plunger 42 by a spring. Thus, when lock handle 35 is turned to the right, crank 47 moves slightly to the right to tension the spring 48 to withdraw the plunger 42 from the locking grooves 39, but when the handle 35 is in the up position the tension on spring 48 is relaxed so that the plunger is free to move back to its locking position.

It will now be seen that the invention provides a rather simple, but sturdy, readily assembled, and low cost multiple purpose exerciser which besides being adapted to do different exercises can also be adapted to suit the physical needs of different users. The units of FIGS. 1 and 2 can be offered separately as distinct leg and hip exercisers, or they can be sold as a multiple exerciser with parts 21, 22, 30, 31, and sub-assembly 35–48 being provided as accessories to be used to suit the purchaser's needs. In other words, the FIG. 2 arrangement can be easily converted to the FIG. 1 arrangement simply by removing the board 30 and the rod 38 from tube 37 and re-installing the cradles 21 and the toe rest 22. To go back to the FIG. 2 arrangement from the FIG. 1 arrangement really all that is needed is to lift the toe piece 22 out and reinsert the rod 38 in tube 37 and replace the board 30 in position.

The members 14 of the side frames 13–16 of course serve as slides or guideways for the movable weighted carriage 17, 18. They are made from sturdy metal stock so that they can be safely weighted for 1,500 pounds or even more if so desired. Besides being versatile, the device is also safe for the user. Stops 19, 20 are provided for the weighted carriage. These stops can be made adjustable if so desired, and more or less weight can be readily placed on the rods 17'. Additionally, locking means is provided in both situations, that is for the toe piece 22 and the board 30 so that there will be no accidents, but still, both the toe piece 22 and board 30 can be adjusted to suit the needs of the individual user.

I claim:

1. In an exerciser having a generally rectangular shaped open bottom frame having spaced apart side and end members, spaced upwardly sloped side frames on said bottom frame, and a weighted carriage movable along said side frames, a pair of spaced cradles on said carriage, said cradles being adapted to nest the shoulders of a user of said exerciser standing inside said open bottom frame adjacent one end thereof corresponding to the lower end of said sloped side frames, a foot rest at said one end of said bottom frame, said foot rest being adapted to brace the exercise user's toes when leaning forward to lift said carriage, means for adjustably positioning and locking said foot rest in a plurality of positions lengthwise of said end of said bottom frame, said last mentioned means comprising a pair of angle irons on said opposite sides of said bottom frame, a series of spaced apart horizontal lugs on said angle irons, said foot rest comprising another angle iron transversely spanning said pair of angle irons, said foot rest being freely and selectively insertable into the spaces between said lugs so that the corner thereof overlies one of said lugs and the edges thereof underlies the two lugs immediately adjacent thereto on each of said pair of angle irons.

* * * * *